US012215440B2

(12) United States Patent
Balzano et al.

(10) Patent No.: US 12,215,440 B2
(45) Date of Patent: Feb. 4, 2025

(54) POLYMER FILLED POLYOLEFIN FIBER

(71) Applicant: Avient Protective Materials B.V., Geleen (NL)

(72) Inventors: Luigi Balzano, Echt (NL); Franciscus Wilhelmus Maria Gelissen, Echt (NL); Francois Antoine Marie Op Den Buijsch, Echt (NL); David Michael Cummins, Echt (NL)

(73) Assignee: AVIENT PROTECTIVE MATERIALS B.V., Geleen (NL)

( * ) Notice: Subject to any disclaimer, the term of this patent is extended or adjusted under 35 U.S.C. 154(b) by 292 days.

(21) Appl. No.: 17/773,366

(22) PCT Filed: Nov. 3, 2020

(86) PCT No.: PCT/EP2020/080789
§ 371 (c)(1),
(2) Date: Apr. 29, 2022

(87) PCT Pub. No.: WO2021/089529
PCT Pub. Date: May 14, 2021

(65) Prior Publication Data

US 2022/0364275 A1 Nov. 17, 2022

(30) Foreign Application Priority Data

Nov. 4, 2019 (EP) ..... 19206846

(51) Int. Cl.
*D01F 8/06* (2006.01)
*D01F 1/02* (2006.01)
(Continued)

(52) U.S. Cl.
CPC ..... *D01F 8/06* (2013.01); *D01F 1/02* (2013.01); *D01F 8/12* (2013.01); *D01F 8/14* (2013.01);
(Continued)

(58) Field of Classification Search
None
See application file for complete search history.

(56) References Cited

U.S. PATENT DOCUMENTS 3,431,322 A 3/1969 Caldwell
4,455,273 A 6/1984 Harpell et al.
(Continued)

FOREIGN PATENT DOCUMENTS

CA 2035570 8/1991
CN 10420406 12/2014
(Continued)

OTHER PUBLICATIONS

International Search Report and Written Opinion of the ISA for PCT/EP2020/080789, mailed Jan. 29, 2021, 15 pages.

*Primary Examiner* — Shawn Mckinnon
(74) *Attorney, Agent, or Firm* — NIXON & VANDERHYE P.C.

(57) ABSTRACT

The present invention relates to a polyolefin fiber comprising polymeric structures, wherein the polymeric structures individually comprise a polycondensate and a functionalized polymer, and the polyolefin fiber is a gel-spun high-performance polyethylene fiber that has a tenacity of at least 1 N/tex. The polymeric structures are immiscible with and dispersed in the polyethylene fiber. The gel-spun high-performance polyethylene fiber is a gel-spun ultrahigh molecular weight polyethylene fiber. The present invention further relates to a process for making the polyolefin fiber comprising the steps of: melt-mixing the polycondensate or a polycondensate containing at least one additive, the functionalized polymer, and optionally the thermoplastic polymer and/or the at least one additive, to form polymeric structures; mixing polyolefin powder, the polymeric structures and a solvent to form a mixture; and spinning and
(Continued)

drawing the mixture obtained in step ii) to form the polyolefin fiber comprising the polymeric structures.

16 Claims, 1 Drawing Sheet

(51) Int. Cl.
*D01F 8/12* (2006.01)
*D01F 8/14* (2006.01)

(52) U.S. Cl.
CPC .. *D10B 2321/0211* (2013.01); *D10B 2321/08* (2013.01); *D10B 2331/02* (2013.01); *D10B 2331/04* (2013.01)

(56) References Cited

U.S. PATENT DOCUMENTS

| | | | |
|---|---|---|---|
| 5,576,366 | A | 11/1996 | Sheth |
| 5,901,632 | A | 5/1999 | Ryan |
| 2005/0217037 | A1 | 10/2005 | Negola |
| 2005/0222328 | A1 | 10/2005 | Bruls et al. |
| 2005/0239927 | A1 | 10/2005 | Leggio et al. |
| 2015/0361615 | A1 | 12/2015 | Negola |

FOREIGN PATENT DOCUMENTS

| | | |
|---|---|---|
| CN | 103866416 | 2/2016 |
| EP | 0 205 960 | 12/1986 |
| EP | 0 269 151 | 6/1988 |
| EP | 0 398 843 | 11/1990 |
| EP | 1 492 843 | 1/2005 |
| EP | 1 869 129 | 2/2012 |
| EP | 3 502 326 | 6/2019 |
| GB | 2 042 414 | 9/1980 |
| GB | 2 051 667 | 1/1981 |
| JP | S59-130316 | 7/1984 |
| JP | H03-227339 | 10/1991 |
| JP | H06-322610 | 11/1994 |
| JP | 2008-538391 | 10/2008 |
| WO | 01/73173 | 10/2001 |
| WO | 2011/015485 | 2/2011 |
| WO | WO 2013/139784 | 9/2013 |
| WO | 2014/064157 | 5/2014 |

POLYMER FILLED POLYOLEFIN FIBER

This application is the U.S. national phase of International Application No. PCT/EP2020/080789 filed Nov. 3, 2020, which designated the U.S. and claims priority to EP patent application Ser. No. 19/206,846.8 filed Nov. 4, 2019, the entire contents of each of which are hereby incorporated by reference.

The invention relates to a polyolefin fiber comprising polymeric structures. The invention also relates to a process for making the polyolefin fiber comprising polymeric structures. Furthermore, the invention relates to an article comprising the polyolefin fiber.

Polyolefin fiber comprising polymeric structures are generally known in the art. For instance, EP1869129B1 discloses a polyolefin fiber comprising a polyolefin, preferably polypropylene, and a dye enhancer being a maleic anhydride-based polyolefin compatibilizer and optionally, a terephthalate-based copolyester. US2015/0361615A1 discloses polyolefin fibers formed by blending the olefin, preferably polypropylene, with a masterbatch comprised of amorphous nylon, olefin-modified with maleic anhydride, and nylon 6 or 6,6 and dyeing the blended olefin using a nylon dyeing system.

However, it is known that the mechanical properties of the polyolefin fiber known in the art drastically deteriorate because of introducing defects, e.g. different (polymeric) structures in the composition of the polyolefin fiber. In addition, it is also well-known that gel-spun, high-performance polyolefin fibers, in particular high-performance polyethylene (HPPE) fibers, are difficult to be functionalized because of the intrinsic non-polar nature of the polyolefin, e.g. polyethylene. Moreover, in case of melt-spun high-performance polyolefin fibers, e.g. HPPE fibers, the inventors observed that in case an additive, e.g. a polycondensation polymer particles, such as a polyester particles are added in the fiber, this should be molten and partially miscible with the high-performance polyolefin fiber in order to be able to obtain dispersed particles. Furthermore, the tenacity of the melt-spun or melt-extruded high-performance polyolefin fibers known in the art, e.g. HPPE fibers, is lower than 1 N/tex.

Therefore, the objective of the present invention is to provide a polyolefin fiber for which very high levels of mechanical properties, e.g. tenacity and/or modulus, in particular of tenacity, are maintained even when introducing polymeric structures in the composition of the fiber, and even at higher amounts of polymeric structures in the fiber composition, while the polyolefin fiber is also versatile for being used in different applications, e.g. for making textiles having good dyeability and color fastness.

This objective has been achieved by providing a polyolefin fiber comprising polymeric structures, with the polymeric structures individually comprising a polycondensate and a functionalized polymer, and wherein the polyolefin fiber is a gel-spun high-performance polyethylene fiber comprising the polymeric structures and having a tenacity of at least 1 N/tex whereby the polymeric structures are immiscible with and dispersed in the polyethylene fiber.

It has surprisingly been found that the gel-spun high-performance polyethylene fiber according to the present invention, i.e. comprising the polymeric structures that are preferably dispersed in the fiber (which individually, i.e. each of the polymeric structures comprises a polycondensate and a functionalized polymer), keeps high mechanical properties, in particular high tenacities, even at high polymeric structures concentrations in the polyolefin (HPPE) fiber.

Moreover, it has been found that the polyolefin (HPPE) fiber according to the invention can be easier functionalized, such that the fiber according to the invention can be used in different applications. Furthermore, the fabrics containing the polyolefin fiber according to the present invention have good colourability and colour fastness.

Within the context of the present invention, "fiber" is understood to be an elongated body with length dimension much greater than its transversal dimensions, e.g. width and thickness. The term fiber includes a filament, a yarn, a ribbon, a strip or a tape and the like, and can have a regular or an irregular cross-section. Preferably, the fiber is a yarn, more preferably a multifilament yarn. A tape for the purposes of the present invention may have a cross-sectional aspect ratio of at least 5:1, more preferably at least 20:1, even more preferably at least 100:1 and yet even more preferably at least 1000:1. The width of the tape may be between 1 mm and 200 mm, preferably between 1.5 mm and 50 mm, and more preferably between 2 mm and 20 mm. Thickness of the flat tape preferably is between 10 μm and 200 μm and more preferably between 15 μm and 100 μm.

Preferably, the high-performance polyethylene (HPPE) fiber has a tenacity (that can be also referred to herein as tensile strength) of at least 1.5 N/tex, preferably at least 2 N/tex, more preferably at least 2.5 N/tex and more preferably of at least 3.5 N/tex, or at least 4 N/tex, as measured according to the method as described in the Example section of this patent. Preferably the HPPE fiber has a tensile modulus of at least 30 N/Tex, more preferably of at least 50 N/Tex, still more preferably of at least 80 N/Tex or even of at least 90 N/Tex, most preferably of at least 100 N/Tex. In the context of the present invention tensile strength or tenacity and tensile modulus are defined and determined on multifilament yarns as specified in ASTM D885M (using a nominal gauge length of the fiber of 500 mm, a crosshead speed of 50%/min and Instron 2714 clamps, of type "Fibre Grip D5618C"; the modulus was determined as the gradient between 0.3 and 1% strain).

Preferred high-performance polyethylene is high molecular weight (HMWPE) or ultrahigh molecular weight polyethylene (UHMWPE) or a combination thereof.

For practical reasons, the titer of the HPPE fiber, that may be a multifilament yarn, can be at least 100 dtex and most 50000 dtex, preferably at most 20000 dtex, more preferably at most 10000 dtex, most preferably at most 5000 dtex. Preferably, the titer of the HPPE fiber, preferably of the HPPE yarn, is in the range of 100 to 10000 dtex, more preferably 500 to 7000 dtex, yet more preferably of from 1000 to 6000 dtex and most preferably in the range from 500 to 4000 dtex, yet most preferably in the range of 800 to 3500 dtex. The titer was determined according to the method described in the Examples section of this patent.

In the context of the present invention, the expression 'substantially consisting of' has the meaning of 'may comprise a minor amount of further species' wherein minor is up to 5 wt %, preferably of up to 2 wt % of said further species or in other words 'comprising more than 95 wt % of' preferably 'comprising more than 98 wt % of' HPPE, e.g. HMWPE and/or UHMWPE.

In the context of the present invention, the polyethylene (PE) may be linear or branched, whereby linear polyethylene is preferred. Linear polyethylene is herein understood to mean polyethylene with less than 1 side chain per 100 carbon atoms, and preferably with less than 1 side chain per 300 carbon atoms; a side chain or branch generally containing at least 10 carbon atoms. Side chains may suitably be measured by FTIR. The linear polyethylene may further contain up to 5 mol % of one or more other alkenes that are copolymerisable therewith, such as propene, 1-butene, 1-pentene, 4-methylpentene, 1-hexene and/or 1-octene.

The PE is preferably of high molecular weight with an intrinsic viscosity (IV) of at least 2 dl/g; more preferably of at least 4 dl/g, most preferably of at least 8 dl/g. Such polyethylene with IV exceeding 4 dl/g are also referred to as ultrahigh molecular weight polyethylene (UHMWPE). Intrinsic viscosity is a measure for molecular weight that can more easily be determined than actual molar mass parameters like number and weigh average molecular weights (Mn and Mw).

The polymeric structures in the context of the invention are understood to be structures or droplets, preferably dispersed in the HPPE fiber, that are (substantially) immiscible, i.e. form an inhomogeneous mixture, with the high-performance polyethylene (HPPE) fiber. The polymeric structures may be found inside the high-performance polyethylene fiber but may also occur on its the surface. Suitable polymeric structures and manufacturing process are described, for instance, in US2005/0222328, incorporated herein by reference.

The amount of the polymeric structures in the HPPE fiber is preferably at least 0.001 wt %, more preferably at least 1 wt %, even more preferably at least 3 wt %, most preferably at least 5 wt %, based on total weight of the HPPE fiber. The amount of the polymeric structures in the HPPE fiber is preferably at most 20 wt %, preferably at most 15 wt %, more preferably at most 12 wt %, most preferably at most 10 wt %, based on total weight of the HPPE fiber. Higher amounts of the polymeric structures may affect negatively the mechanical properties of the HPPE fiber.

The polymeric structures or droplets are preferably dispersed in the polyolefin fiber. The polymeric structures may have any shape, for instance they may be in the shape of particles or fibers (needles) and may be also referred herein to as dispersed particles or dispersed fibers. In case the polymeric structures are spherical, the L/D ratio is preferably about 1 and these particles preferably melt at a temperature above the processing temperature of the fiber, during manufacturing of the fiber, e.g. during drawing. In case the polymeric structures have a needle shape, the L/D ratio is preferably higher than 1 and these particles preferably melt at a temperature below the processing temperature during manufacturing of the fiber, e.g. during drawing.

In the present invention, for particles with no dimension substantially larger than the other dimensions of the particle, such as particles of spherical or cubical shape, the average particle size is substantially equal to the average particle diameter (D), or in short, the diameter. In the context of the present invention average means number (or numerical) average if not stated differently. For particles of substantially oblong shape, e.g. elongated or non-spherical or anisotropic, such as needles, fibrils or fibers, the particle size may refer to the average length dimension (L), along the long axis of the particle, whereas the average particle diameter, or in short the diameter as may be also referred herein, refers to the average diameter of the cross-section that is perpendicular to the length direction of said oblong shape. In case the cross-section of the particle is not circular, the average diameter (D) is determined with following formula: $D=1.15*A^{1/2}$, wherein A is the cross-section area of the particle. The aspect ratio of a polymeric structures (L/D) is the ratio between the length, i.e. average length (L) and the diameter, i.e. average diameter (D) of the polymeric structures. The average diameter and the aspect ratio of the polymeric structures may be determined by using any method known in the art, for instance SEM method as described in the Experimental section of this specification.

Selection of an appropriate particle size, diameter and/or length typically depends on the processing and on the filament titer of the fiber. Nevertheless, the particles should be small enough to pass through the spinneret apertures. The particle size and diameter may be selected small enough to avoid large deterioration of the filled HPPE fiber tensile properties. The particle size and diameter may have a log normal distribution.

The particle size of the polymeric structures may vary depending on the application of the HPPE fiber and is preferably less than ⅓ from the HPPE fiber average diameter.

The polycondensate in the HPPE fiber according to the present invention may be any polycondensation polymer as known in the art. Polycondensation polymers and are typically obtained in a polycondensation reaction accompanied by the cleavage of a low-molecular reaction product. Polycondensate polymers are for instance known from documents EP1492843, U.S. Pat. No. 5,576,366, US2005/0239927A1, US2015/0361615A1, EP1869129B1. Examples of suitable polycondensation polymers are thermoplastic polycondensates that may be crystallizable or amorphous. The polycondensation polymer may be selected from the group consisting of e.g., polyamide, polyester, such as polycarbonate or polylactide, polyurethanes, and/or copolymers thereof. The polycondensation reaction to obtain a polycondensation polymer is known in the art and can take place directly between the monomers or via an intermediate stage, which subsequently is converted via transesterification, wherein transesterification is in turn accompanied by the cleavage of a low-molecular reaction product or take place via ring opening polymerization. The polycondensate may be liner or branched.

The polyamide is typically known in the art as being a polymer obtained via polycondensation from its monomers, either a diamine component and a dicarbonic acid component or a bifunctional monomer with an amino and carbonic acid end group, wherein the reaction can also take place via ring opening polymerization, e.g., using lactames. Suitable examples include any semi-crystalline polyamide or blends thereof, as well as copolyamides. "Semi-crystalline polyamide" is here understood to encompass polyamides having crystalline and amorphous regions. Suitable polyamides include aliphatic polyamides such as PA6, PA66, PA46, PA410, PA610, PA11, PA12, PA412 as well as blends thereof, but also semi-aromatic polyamides. Suitable semi-aromatic polyamides include terephthalic acid-based polyamides like PA6T, PA9T, PA4T and PA6T61, PA10T as well as PAMXD6 and PAMXDT, and copolyamides thereof, as well as blends thereof, as well as blends of aliphatic and semi-aromatic polyamides.

The polyester is typically known in the art as a polymer obtained through polycondensation from its monomer, a diol component and a dicarbonic acid component. Various, mostly linear or cyclic diol components can be used in the HPPE fiber according to the present invention. Different, mostly aromatic dicarbonic acid components can also be used. The dicarbonic acid can also be replaced by its corresponding dimethyl ester. Suitable examples for polyester include polyethylene terephthalate (PET), polybutylene terephthalate (PBT) and polyethylene naphthalate (PEN), which can be used either as homopolymers or copolymers.

The amount of the polycondensate may be at least 0.1 wt % and at most 50 wt %, based on the total composition of the HPPE fiber according to the invention, preferably between 0.1 and 30 wt %, yet preferably between 0.1 and 20 wt %, more preferably between 0.1 and 10 wt %, yet more preferably between 0.1 and 5 wt %, and most preferably between 0.1 and 3 wt %, based on the total composition of the HPPE fiber according to the invention.

Functionalized polymers are here understood to be polymers that have functional groups, preferably end functional groups, which can react with other functional groups. Examples of suitable functional groups are carboxylic acid groups, anhydride groups, ester groups, salt groups, ether groups, epoxy groups, amine groups, alkoxy silane groups, alcohol groups or oxazoline groups. Suitable functional polymers are disclosed in documents e.g. EP1492843, U.S. Pat. No. 5,576,366, US2005/0239927A1, US2015/0361615A1, EP1869129B. Preferably, the functional group is chosen from the group of maleic anhydride (MAH) and epoxy.

Suitable polymers that can be provided with functional groups include for example ethylene (co)polymers, for instance selected from the group consisting of homopolymers of ethylene, and copolymers of ethylene with one or more alpha-olefin comonomer with 3-10 C-atoms, in particular propylene, isobutene, 1-butene, 1-hexene, 4-methyl-1-pentene and 1-octene, that can be prepared by any method known in the art, e.g. by using the known catalysts such as for example Ziegler-Natta, Philips and single-site catalysts. The quantity of comonomer in the ethylene copolymer may be between 0 and 50 wt. %, and preferably between 5 and 35 wt. %. Such polyethylenes are known in the art as high-density polyethylene (HDPE), low-density polyethylene (LDPE), linear low-density polyethylene (LLDPE), linear very low-density polyethylene (VL (L) DPE) and plastomers.

The functional groups may be present in the polymer intrinsically, such as in copolymers, but may also be present due to grafting. Suitable polymers in which a functional group is intrinsically present include for example ethylene vinyl acetate (EVA), ethylene methylacrylate (EMA), ethylene butylacrylate (EBA), poly vinyl acetate (PVA), poly glycidyl methacrylate (PGMA), styrene maleic anhydride (SMA) and ionomers.

Preferably, the functional group is present in the polymer by grafting for example an ethylenically unsaturated functionalized compound on the polymer. Suitable ethylenically unsaturated functionalized compounds are those which can be grafted on at least one of the aforesaid suitable polyolefins. The ethylenically unsaturated functionalized compounds contain a carbon-carbon double bond and can form a side branch on a polymer by grafting thereon. Examples of suitable ethylenically unsaturated functionalized compounds are the unsaturated carboxylic acids and esters and anhydrides and metallic or non-metallic salts thereof. Preferably the ethylenic unsaturation in the compound is conjugated with a carbonyl group. Examples are acrylic, methacrylic, maleic, fumaric, itaconic, crotonic, methyl crotonic and cinnamic acid and esters, anhydrides and possible salts thereof. Of the compounds with at least one carbonyl group, maleic anhydride is preferred. Examples of suitable ethylenically unsaturated functionalized compounds with at least one epoxy ring are, for example, glycidyl esters of unsaturated carboxylic acids, glycidyl ethers of unsaturated alcohols and of alkyl phenols and vinyl and allyl esters of epoxy carboxylic acids. Glycidyl methacrylate is particularly suitable. Examples of suitable ethylenically unsaturated functionalized compounds with at least one amine functionality are for example allyl amine, propenyl, butenyl, pentenyl and hexenyl amine, amine ethers, for example isopropenylphenyl ethylamin ether.

The amine group and the unsaturation are typically in such a position relative to each other that they do not influence the grafting reaction to any undesirable degree. The amines may be unsubstituted but may also be substituted with for example alkyl and aryl groups, halogen groups, ether groups and thioether groups.

Examples of suitable ethylenically unsaturated functionalized compounds with at least one alcohol functionality are all ethylenically unsaturated compounds with a hydroxyl group that may or may not be etherified or esterified, for example allyl and vinyl ethers of alcohols such as ethyl alcohol and higher branched and unbranched alkyl alcohols as well as allyl and vinyl esters of alcohol substituted acids, preferably carboxylic acids and C3-C8 alkenyl alcohols.

The functionalized polymer may be chosen from the group of grafted (co)polyolefin (e.g. (co)polyethylene) and poly(glycidyl methacrylate). More preferred the functionalized polymer is a polyolefin, preferably a grafted polyethylene. Preferably, the polyethylene is grafted with an ethylenically unsaturated functionalized compound.

The functionalized polymer can have 0.01 to 50 wt % of functional groups, in which the weight percentage is based on the total amount of functionalized polymer. Preferably the functionalized polymer has at least 0.05 wt % functional groups and more preferably at least 0.1 wt % functional groups, in which the weight percentage is based on the total amount of functionalized polymer. Preferably the functionalized polymer has at most 40 wt % of functional groups, more preferably at most 30 wt % and even more preferably at most 20 wt % of functional groups, in which the weight percentage is based on the total amount of functionalized polymer.

The amount of the functionalized polymer may be at least 0.01 wt % and at most 50 wt %, based on the total amount of the polycondensate, preferably between 0.01 and 30 wt %, yet preferably between 0.01 and 20 wt %, more preferably between 0.01 and 10 wt %, yet more preferably between 0.1 and 5 wt %, based on the total amount of the polycondensate.

The polyolefin fiber according to the present invention may further comprise a thermoplastic polymer. Any thermoplastic polymer known in the art can be used in the HPPE fiber according to the invention with the condition that the thermoplastic polymer is soluble, preferably 100% soluble, in the (spin) solvent as defined herein, which is preferably a non-polar solvent.

The thermoplastic polymer is preferably a polymer having a density as measured according to ISO1183-2004 in the range from 875 to 1000 kg/m$^3$. More preferably, the thermoplastic polymer is selected from a group consisting of homopolymers of ethylene, homopolymers of propylene, ethylene copolymers and propylene copolymers, and/or mixtures thereof.

The polymeric structures may further contain (individually) at least one additive. Any conventional additives known in the art may be used, such as ionic or non-ionic surfactants, tackyfying resins, stabilizers, such as UV stabilizers, flame-retardant, anti-oxidants, colorants, reinforcing fillers, such as mineral fillers or other additives modifying the properties of the polymeric structures.

The polymeric structures containing the thermoplastic polymer and/or at least one additive may have a particle size, d50, measured by SEM method according to the Examples sections herein of at least 50 nanometers and at most 1000 nanometers, preferably of between 100 and 600 nanometers, more preferably between 100 and 500 nanometers, most preferably between 150 and 400 nanometers, even most preferably between 150 and 250 nanometers. Higher particle sizes (d50) tend to deteriorate mechanical properties of the HPPE fiber. Smaller particles were found to lower the ability of the fiber to be dyed.

The sum of the amounts of all components of the polymeric structures according to the present invention, i.e. the polycondensate, the functional polymer, and optionally at least one additive should be 100% (provided that the additive is considered an integral part of each polymer).

The polyolefin fiber according to the present invention can further comprise other fibers, that are different than the fiber of the invention, e.g. different in composition and/or shape, such as non-polymeric fibers, e.g. fibers of glass, carbon, basalt, metal wire or thread; and/or natural fibers, e.g. cotton; bamboo; and/or polymeric fibers, e.g. polyamide fibers, such as nylon fibers, elastic fibers, e.g. elastane fibers, polyester fibers; and/or mixtures of these other fibers, that may be present in any ratio.

The present invention also relates to a process for making the polyolefin fiber as described herein, the process comprising the following steps:

i) melt-mixing the polycondensate, the functionalized polymer, and optionally the thermoplastic polymer and/or the at least one additive, to form polymeric structures;
ii) mixing polyolefin powder, preferably UHMWPE powder, the polymeric structures and a solvent for the polyolefin to form a mixture; and
iii) spinning and drawing the mixture obtained in step ii) to form the gel-spun polyolefin fiber, i.e. the gel-spun HPPE fiber, comprising polymeric structures, as defined in claim 1.

Alternatively step ii) can be performed by mixing the polyolefin powder and a solvent to form a first mixture; mixing the polymeric structures and a solvent to form a second mixture where after both first and second mixtures are mixed together.

Preferably, in case the polymeric structures comprise at least one additive, there is a step i'), which is performed before step i), with step i') comprising melt-mixing the polycondensate (which is the continuous phase) and at least one additive to form a polycondensate containing additive(s) concentrate. The concentrate that may be obtained in step i') is a high concentrated compound, i.e. comprises or consists of at least 50 vol %, preferably at least 60 vol %, more preferably at least 80 vol %, most preferably at least 90 vol % or at least 95 vol %, based on the total vol. of polycondensate and additive(s). The amount wt % of the additive(s) in the dispersion typically depends on the density of the additives.

Preferably, the polycondensate or the polycondensate containing additive(s) dispersion obtained in step i'), the functionalized polymer and, optionally the thermoplastic polymer are mixed together at a temperature that is above the melting temperatures (Tm) or glass transition temperatures (Tg) in case of amorphous polymers of all components, in order to form polymeric structures.

The functional polymer can be added in an amount of at most 30 wt %, preferably at most 20 wt %, and most preferably at most 10 wt %, based on the total weight of the polycondensate. The thermoplastic polymer may be added in an amount of at least 20 wt % and at most 95 wt %, preferably of at least 30 wt % to at most 90 wt %. The sum of all these components should add up to 100% (provided that the additive is considered an integral part of the polymer).

The melt-mixing steps (which may also be referred herein as to liquid-mixing and means that the components are mixed together in molten state) can be performed by using any method, conditions and equipment known in the art, for instance from document EP1492843B1. For instance, the melt-mixing can take place at a speed of from about 50 to 1200 rpm, in particular from 100 to 400 rpm in a twin-extruder or batch kneader, and a temperature profile of 150-280° C., depending on the melting temperature of the components of the polymeric structures.

Preferably, step ii) takes place above room temperature. The higher the temperature at step ii), the fastest the mixing step is. The maximum temperature at step ii) is the temperature at which the solvent starts to evaporate and may be limited by the safe handling of the solvent, e.g. decalin. Higher temperatures may lead to faster dissolution but one can have a problem with safety. The solvent used in step ii) is a solvent for the polyolefin and a non-solvent for the components, e.g. for the polycondensate in the polymeric structures.

Preferably, the process for making the gel-spun HPPE fiber as described herein, comprises the following steps:

a) melt-mixing the polycondensate or the polycondensate containing at least one additive, a functionalized polymer and, optionally a thermoplastic polymer, at a temperature that is the maximum temperature between the melting temperatures (Tm) or glass transition temperatures (Tg) of all components, to form polymeric structures;
b) dispersing the polymeric structures formed in step a) in a solvent (i.e. polyolefin solvent) to form a suspension;
c) forming separately a suspension of HPPE powder, preferably UHMWPE powder and the solvent;
d) adding the suspension of step b) to the suspension of step c) to form a mixture; and then
e) spinning and drawing the mixture obtained in step d) to form a gel-spun HPPE fiber comprising polymeric structures, according to the present invention.

The gel-spun HPPE fiber according to the present invention is obtained by a gel-spinning process. The gel-spun HPPE fiber may contain at most 500 ppm solvent as defined herein, preferably at most 400 ppm, more preferably at most 300 ppm, even more preferably at most 200 ppm, most preferably at most 100 ppm solvent and yet most preferably at most 50 ppm.

Any gel-spinning process to make the HPPE fiber according to the present invention may be used. A suitable gel-spinning process is described in for example GB-A-2042414, GB-A-2051667, EP 0205960 A and WO 01/73173 A1. In short, the gel spinning process comprises preparing a solution of a polyethylene of high intrinsic viscosity and the polymeric structures in a solvent (solvent for polyolefin, which is a non-solvent for the polyconsensate), extruding the solution into a solution-fiber at a temperature above the dissolving temperature, cooling down the solution-fiber below the gelling temperature, thereby at least partly gelling the polyethylene of the fiber, and drawing the fiber before, during and/or after at least partial removal of the solvent.

In the described methods to prepare HPPE fiber drawing, preferably uniaxial drawing, of the produced HPPE fibers may be carried out by means known in the art. Such means comprise extrusion stretching and tensile stretching on suitable drawing units. To attain increased mechanical tensile strength and stiffness, drawing may be carried out in multiple steps.

In case of the preferred UHMWPE fiber, drawing is typically carried out uniaxially in a number of drawing steps. The first drawing step may for instance comprise drawing to a stretch factor (also called draw ratio) of at least 1.5, preferably at least 3.0. Multiple drawing may typically result in a stretch factor of up to 9 for drawing temperatures up to 120° C., a stretch factor of up to 25 for drawing temperatures up to 140° C., and a stretch factor of 50 or above for drawing temperatures up to and above 150° C. By multiple drawing at increasing temperatures, stretch factors of about 50 and more may be reached.

This process results in gel-spun HPPE fiber according to the present invention, preferably UHMWPE gel-spun fibers, with tenacity of at least 1 N/tex, preferably at least 2 N/tex, more preferably at least 3 N/tex, even of at least 3.5 N/tex or of at least 4 N/tex.

Any known in the art solvents suitable for gel-spinning of HPPE, and in particular UHMWPE, may be used, hereinafter said solvents being referred to as spin solvents. Said solvent is preferably any nonpolar solvent known in the art. Suitable examples of solvents include aliphatic and alicyclic hydrocarbons such as octane, nonane, decane and paraffins, including isomers thereof; petroleum fractions; mineral oil; kerosene; aromatic hydrocarbons such as toluene, xylene, and naphthalene, including hydrogenated derivatives thereof such as decalin and tetralin; halogenated hydrocarbons such as monochlorobenzene; and cycloalkanes or cycloalkenes such as careen, fluorine, camphene, menthane, dipentene, naphthalene, acenaphtalene, methylcyclopentandien, tricyclodecane, 1,2,4,5-tetramethyl-1,4-cyclohexadiene, fluorenone, naphtindane, tetramethyl-p-benzodiquinone, ethylfuorene, fluoranthene and naphthenone. Also, combinations of the above-enumerated spinning solvents may be used for gel-spinning, the combination of solvents being also referred to for simplicity as spin solvent. It is found that the present process is especially advantageous for relatively volatile solvents, like decalin, tetralin and several kerosene grades. Preferably, the solvent is decalin. Spin solvent can be removed by evaporation, by extraction, or by a combination of evaporation and extraction routes.

Standard equipment may be used for obtaining the gel-spun HPPE fiber, preferably a twin-screw extruder, wherein in the first part the polyolefin is dissolved in the solvent, wherein at the end of the first part the fibers are fed to the extruder via a separate feed opening.

The HPPE fibers comprising polymeric structures according to the invention may be also obtained by using a masterbatch process.

It is also possible to convert the polyolefin fibers containing the polymeric structures according to the present invention into staple fibers and to process these staple fibers into a spun yarn.

The present invention also directs to an article comprising the polyolefin fiber of the invention. Articles containing the fibers of the invention may be, but are not limited to product chosen from the group consisting of fishing lines, fishing nets, ground nets, cargo nets, curtains, kite lines, dental floss, tennis racquet strings, canvas, fabrics, woven cloths, non-woven cloths, webbings, battery separators, medical devices, capacitors, pressure vessels, hoses, umbilical cables, automotive equipment, power transmission belts, building construction materials, cut resistant articles, stab resistant articles, incision resistant articles, protective gloves, composite sports equipment, skis, helmets, kayaks, canoes, bicycles and boat hulls, speaker cones, high performance electrical insulation, radomes, sails, and geotextiles.

Fabrics that may contain the polyolefin (HPPE) fibers according to the invention may be woven or non-woven and can be produced by any process known in the art. The fabrics can be made by knitting, weaving or by other methods, by using conventional equipment.

The polyolefin (HPPE) fiber according to the invention can be coated or uncoated. A protective cover and/or a coating may be applied on the surface of the HPPE fiber. Such cover may be can be any known material, like a knitted, woven or braided fabric, e.g. a woven polyester fabric or braided abrasion resistant UHMWPE fiber cover. The coating may be as for instance described in WO2014/064157A1, or a coating being a crosslinked silicone, as disclosed in document WO2011/015485, incorporated herein by reference.

The polyolefin (HPPE) fiber according to the present invention may be post-stretched, preferably at a temperature in the range 80-140° C., more preferably between 90-130° C. to further increase its strength. Such a post-stretching step is described in documents e.g. EP 0398843 B1 and U.S. Pat. No. 5,901,632, incorporated herein by reference.

The invention will be further explained by the following examples and comparative experiments, however first the methods and materials used in determining the various parameters useful in defining the present invention are hereinafter presented.

Methods dtex: fiber's titer was measured by weighing 100 meters of fiber. The dtex of the fiber was calculated by dividing the weight (expressed in milligrams) by 10.

Heat of fusion and peak melting temperature and Tg were measured according to standard DSC methods ASTM E 794 and ASTM E 793 respectively at a heating rate of 10K/min for the second heating curve and performed under nitrogen on a dehydrated sample.

The density of the thermoplastic polymer was measured according to ISO 1183-2004.

Intrinsic Viscosity (IV) of the UHMWPE powder was determined according to method ASTM D1601(2004) at 135° C. in decalin, the dissolution time being 16 hours, with BHT (Butylated Hydroxy Toluene) as anti-oxidant in an amount of 2 g/l solution, by extrapolating the viscosity as measured at different concentrations to zero concentration.

Tensile properties of HPPE fiber: tenacity or tensile strength (or strength) and tensile modulus (or modulus) were defined and determined on HPPE multifilament yarns as specified in ASTM D885M. A nominal gauge length of the fiber of 500 mm, a crosshead speed of 50%/min and Instron 2714 clamps, of type "Fiber Grip D5618C" was used. On the basis of the measured stress-strain curve, the modulus was determined as the gradient between 0.3 and 1% strain. For calculation of the modulus and tensile strength, the tensile forces measured were divided by the titre, as determined above; values in GPa may be calculated assuming a density of 0.97 g/cm$^3$ for the HPPE.

Number of olefinic branches per thousand carbon atoms was determined by FTIR on a 2 mm thick compression moulded film by quantifying the absorption at 1375 cm-1 using a calibration curve relative to NMR measurements as in e.g. EP 0 269 151 (in particular pg. 4 thereof).

SEM method: Parts of about 1×1 cm were cut out of a knitted fabric and embedded in an epoxy resin. After curing at room temperature, cross sections were obtained using a diamond knife under cooling with LN2. The obtained block face samples were fixed into a SEM sample holder and coated with a conductive carbon layer. Imaging was done in FEI Versa 3D FEGSEM at an acceleration voltage of 5 kV in combination with a retractable back scattered detector. The elemental composition was measured with EDX in EDAX TEAM software.

Materials

Polycondensate Polymer (P1):

- P1-1: Akulon® K122 (polyamide 6), commercialised by DSM
- P1-2: Amite® 1060, T04-200 (polybutylene terephthalate, PBT), commercialized by DSM
- P1-3: Akulon® F136 (polyamide 6), commercialised by DSM
- P1-4: Platamid® HX2544 (copolyamide PA—Nylon grade), commercialized by Arkema
- P1-5: Arnitel® EM740, commercialised by DSM.

Functional Polymer (P2):

- P2-1: Fusabond® M0525D (polyethylene grafted with 0.9 wt. % maleic anhydride, MA), commercialised by DuPont.
- P2-2: Lotader® 8840 (random copolymer of ethylene and glycidyl methacrylate polymerised in a reactor with 8 wt. % glycidyl methacrylate content, GMA), commercialized by Arkema.

Thermoplastic Polymer (P3):

- P3-1: Queo 8201® (ethylene based octene-1 plastomer, 28% octene, with a density of 0.883 g/cm$^3$, a peak melting point of 74° C.), commercialized by *Borealis*.

Spin Solvent:

- P4-1: decalin

Matrix polymer (HPPE):

- M-1: UHMWPE powder with an IV of 19.0 dl/g.

FIGURES

EXAMPLES

Figure 1:
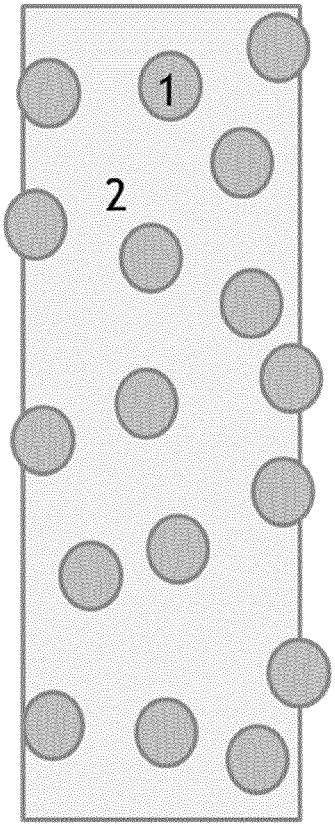
FIG. 1 represents a cross section of a HPPE fiber comprising the dispersed and immiscible polymeric structures (1) or droplets (1), (2) refers to HPPE optionally comprising a thermoplastic polymer.
Figure 2:
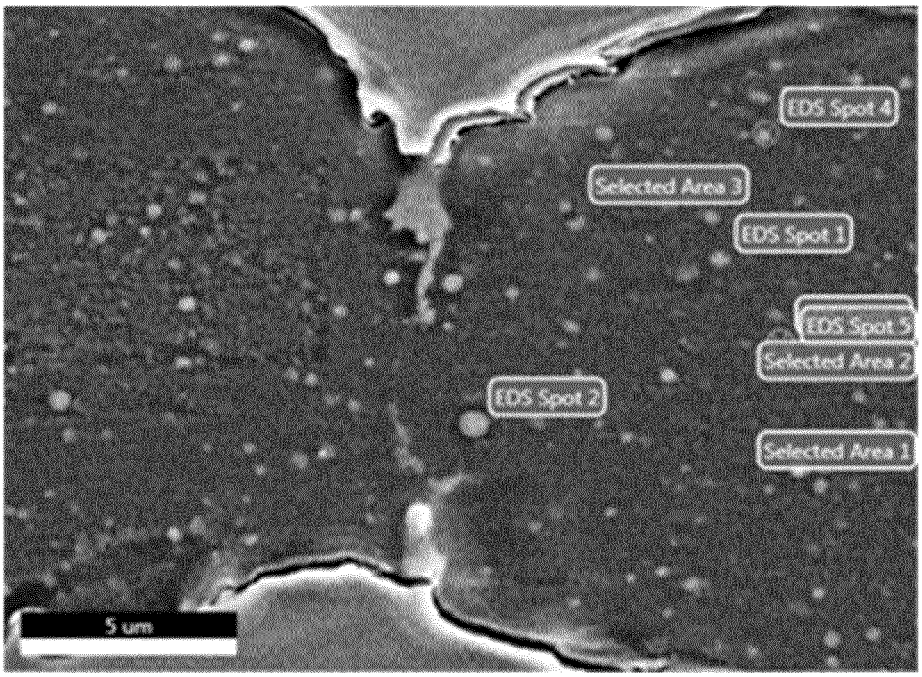
FIG. 2 represents a cross section of two neighbouring HPPE fibers containing the polymeric structures or droplets taken by Energy Dispersive X-ray (EDX) spectroscopy

Five samples of polymeric structures in the form of solid mixtures were prepared via masterbatch by mixing in the solid state in a tumbler having the quantities of the raw materials stated in Table 1. The resulting solid mixtures were metered with the aid of a K-tron metering unit via the throat to a twin-screw extruder (ZE 25UTS from Berstorff), and in this extruder converted into five polymeric structures compositions (MB01-MB05). Polyamide-based masterbatches (MB01, MB02 and MB03) were made in the extruder with a throughput of 20 kg/h at a speed of 400 rpm. The feed zone, barrel, die and outlet temperature of the material are respectively 20, 240, 240 and 300° C. Polyester-based masterbatches (MB04 and MB05) were made with a throughput of 23 kg/h at an extruder speed of 300 rpm. The feed zone, barrel, die and outlet temperature of the material are respectively 20, 260, 260 and 295° C.

TABLE 1

| | P1, wt. % | | | | | P2, wt. % | | P3 wt. % |
|---|---|---|---|---|---|---|---|---|
| | P1-1 | P1-2 | P1-3 | P1-4 | P1-5 | P2-1 | P2-2 | P3-1 |
| MB01 | 30 | — | — | — | — | 70 | — | — |
| MB02 | — | — | 30 | — | — | 7.5 | — | 62.5 |
| MB03 | — | — | — | 30 | — | 7.5 | — | 62.5 |
| MB04 | — | 30 | — | — | — | — | 9 | 61 |
| MB05 | — | — | — | — | 30 | — | 9 | 61 |

Examples 1-10 (Ex. 1-10)

Each MB01-MB05 sample was then dissolved in decalin batches (95 wt % batch and 5 wt % decalin) of about 15 liters, stirring under $N_2$ for about 1 hour at about 110° C. to form five different suspensions (suspension I-V).

Separately, a suspension of UHMWPE powder (M-1) was obtained in decalin, with a concentration of 9 wt. % (suspension VI).

Each of suspension I-V was mixed with suspension VI in a twin-screw extruder having a screw diameter of 25 mm and being equipped with a gear pump to form a mixture. Each mixture obtained was then heated in this way to a temperature of 180° C. The mixture was then pumped through a spinneret having 64 holes, each hole having a diameter of 1 millimeter. The so obtained filaments were drawn in total with a factor of 80 and dried in a hot air oven. After drying, the filaments were bundled and wound on a bobbin.

The composition and properties of fibers obtained according to the Examples 1-10 are shown in Table 2.

Comparative Experiments A-B (CE-A, CE-B)

CE-A was performed in the same way as described for Examples 1-10, with the only difference that suspensions I-V were not used, but only suspension VI was added to the extruder to form an (unfilled) UHMWPE fiber.

CE-B: was performed in the same way as described for Examples 1-10, with the only difference that, instead of using suspensions I-V, inorganic particles of zeolite (commercially available under the tradename Ultrastable Y Zeolide, from ACS Materials, particle size distribution d50 of 6 micron) were used that was mixed with suspension VI to form a zeolite-filled UHMWPE fiber.

The composition and properties of fibers obtained according to CE A-B are shown in Table 2.

TABLE 2

| HPPE fiber | Filler type | Filler amount, wt % | Modulus HPPE fiber, cN/dtex | Elongation at break HPPE fiber, % | HPPE fiber Titer, dtex | HPPE fiber Tenacity, cN/dtex |
|---|---|---|---|---|---|---|
| CE-A | none | none | 1085.1 | 3.3 | 444 | 31.7 |
| CE-B | zeolite | 10 | 652 | 3.2 | 446 | 23.7 |
| Ex. 1 | MB01 | 5 | 1028.2 | 3.4 | 450 | 32.8 |
| Ex. 2 | MB01 | 10 | 972.9 | 3.3 | 446 | 32.1 |
| Ex. 3 | MB02 | 5 | 1008.9 | 3.5 | 452 | 32.8 |
| Ex. 4 | MB02 | 10 | 904.9 | 3.4 | 443 | 30.2 |
| Ex. 5 | MB03 | 5 | 1001.9 | 3.5 | 444 | 32.8 |
| Ex. 6 | MB03 | 10 | 972.5 | 3.4 | 447 | 32.2 |
| Ex. 7 | MB04 | 5 | 1033.8 | 3.6 | 441 | 33.5 |

TABLE 2-continued

| HPPE fiber | Filler type | Filler amount, wt % | Modulus HPPE fiber, cN/dtex | Elongation at break HPPE fiber, % | HPPE fiber Titer, dtex | HPPE fiber Tenacity, cN/dtex |
|---|---|---|---|---|---|---|
| Ex. 8 | MB04 | 10 | 915.2 | 3.5 | 455 | 30.9 |
| Ex. 9 | MB05 | 5 | 1018.8 | 3.6 | 445 | 33.6 |
| Ex. 10 | MB05 | 10 | 962.2 | 3.5 | 446 | 33.0 |

Examples 11-22

Subsequently, the HPPE fibers obtained according to Examples 1-10 and CE-A and CE-B (Dyneema® 440-SK65 fibers) were knitted on a flat knit 13 gauge Shima Seiki knitting machine into a fabric with areal density of 260 grams per square meter in a single jersey construction.

The washed and rinsed fabrics were then subjected to coloring processes with 2 wt % based on the dry fabric of Dark Red Serilene FL dye from Yorkshire.

The dye auxiliaries (2 g/l Univadine DFM, used as diffusion agent) and then the dye were added successively to water, in a dye bath, at a temperature of 50° C. The amounts of auxiliaries and the dye where each 2 wt % based on the weight of the dry fabric. The pH was set to 4.5 using acetic acid. The rinsed fabric was then submerged in the dye bath (approximately 1 liter for 100 g fabric) and then the dye bath temperature was raised (with a rate of 0.8° C./min) to a temperature of 130° C. and kept constant at this temperature for 60 min. The bath was then cooled down rapidly (with a rate of 2° C./min) to 60° C. before the liquid was drained. The dyed fabric was successively rinsed with hot (70° C.) and cold (15° C.) water. The so obtained fabrics were air dried for 24 hours at ambient conditions.

The so obtained colored fabrics have been evaluated for color intensity as reported in Table 3.

TABLE 3

| Fabric | HPPE fiber | ΔE cmc (CMC 2:1) | Crocking Wet Warp | Crocking Wet Weft | Crocking Dry Warp | Crocking Dry Weft | Sublimation | Wash, 40° C. | Wash, 60° C. |
|---|---|---|---|---|---|---|---|---|---|
| Ex. 11 | CE-A | 0 | 4-5 | 4-5 | 4 | 4 | 2-3 | 4-5 | 3-4 |
| Ex. 12 | CE-B | 4.14 | 4-5 | 4-5 | 4 | 4 | 3 | 4.5 | 4 |
| Ex. 13 | Ex. 1 | 1.70 | 4-5 | 4 | 4 | 3-4 | 3 | 4-5 | 4-5 |
| Ex. 14 | Ex. 2 | 1.53 | 4 | 4 | 3-4 | 3-4 | 4 | 4 | 4 |
| Ex. 15 | Ex. 3 | 1.39 | 4 | 4 | 4 | 3 | 3 | 4 | 4 |
| Ex. 16 | Ex. 4 | 2.15 | 4-5 | 3-4 | 3-4 | 3-4 | 4 | 4 | 4 |
| Ex. 17 | Ex. 5 | 1.94 | 4-5 | 3-4 | 4 | 3-4 | 3 | 4 | 3-4 |
| Ex. 18 | Ex. 6 | 2.60 | 4-5 | 3 | 3 | 3 | 3-4 | 4 | 3 |
| Ex. 19 | Ex. 7 | 2.50 | 4 | 4 | 4 | 3-4 | 3-4 | 4-5 | 4 |
| Ex. 20 | Ex. 8 | 4.68 | 4-5 | 4 | 4 | 3-4 | 4 | 4-5 | 4 |
| Ex. 21 | Ex. 9 | 2.67 | 4-5 | 4 | 3-4 | 3-4 | 3-4 | 4 | 4 |
| Ex. 22 | Ex. 10 | 3.60 | 4-5 | 4 | 4 | 3-4 | 4 | 4 | 3-4 |

The results obtained by applying the fiber according to the invention (Examples 1-10 and 13-22) compared with the results according to prior art (CE-A, CE-B and Ex. 11-12) clearly show that the fabrics containing the polymeric structures-filled HPPE fibers according to the present invention have good colourability and colour fastness (i.e. ΔE cmc values of higher than 1, with ΔE cmc being a known parameter used in the art and showing (visual) difference in color between fabrics; crocking and wash values of at least 3-4; and sublimation values of at least 3, see Table 3) and fiber tenacity values that remain at very high level even when increasing the amount of polymeric structures in the fiber (Table 2).

The invention claimed is:

1. A polyolefin fiber comprising:

polymeric structures that are immiscible with and dispersed in the polyolefin fiber, and a thermoplastic polymer, wherein the polymeric structures individually comprise a polycondensate and a functionalized polymer, and wherein the polyolefin fiber is a gel-spun high-performance polyethylene (HPPE) fiber having a tenacity of at least 1 N/tex.

2. The polyolefin fiber according to claim 1, wherein the HPPE fiber is a gel-spun ultrahigh molecular weight polyethylene (UHMWPE) fiber.

3. The polyolefin fiber according to claim 1, wherein the polymeric structures are dispersed particles or dispersed fibers in the HPPE fiber.

4. The polyolefin fiber according to claim 1, wherein the polycondensate is present in an amount of at least 0.1 wt % and at most 50 wt %, based on the total composition of the polyolefin fiber.

5. The polyolefin fiber according to claim 1, wherein the functionalized polymer is present in an amount of at least 0.01 wt % and at most 50 wt %, based on the total amount of the polycondensate.

6. The polyolefin fiber according to claim 1, wherein the polycondensate is selected from the group consisting of polyesters, polyamides and copolymers thereof.

7. The polyolefin fiber according to claim 1, wherein the functionalized polymer is selected from the group consisting of grafted (co) polyethylene and poly(glycidyl methacrylate).

8. The polyolefin fiber according to claim 1, wherein the tenacity of the HPPE fiber comprising the polymeric structures and the thermoplastic polymer is at least 1.5 N/tex.

9. The polyolefin fiber according to claim 1, wherein the polymeric structures have a particle size, d50, of at least 50 nanometers and at most 1000 nanometers.

10. The polyolefin fiber according to claim 1, wherein the thermoplastic polymer has a density as measured according to ISO1183-2004 in a range from 875 to 1000 kg/m$^3$.

11. The polyolefin fiber according to claim 10, wherein the thermoplastic polymer is selected from the group consisting of homopolymers of ethylene, homopolymers of propylene, ethylene copolymers, propylene copolymers and mixtures thereof.

12. The polyolefin fiber according to claim 3, wherein the polymeric structures further comprise at least one additive.

13. A process for making the polyolefin fiber according to claim 1 comprising the steps of:

(i) melt-mixing the polycondensate, the functionalized polymer, the thermoplastic polymer and optionally the at least one additive, to form the polymeric structures;

(ii) mixing a polyolefin powder, the polymeric structures and a solvent to form a mixture; and (iii) spinning and drawing the mixture obtained in step (ii) to form the polyolefin fiber comprising the polymeric structures and the thermoplastic polymer.

14. The process according to claim 13, wherein step (ii) comprises:

(iia) mixing the polyolefin powder and the solvent to form a first mixture;

(iib) mixing the polymeric structures and the solvent to form a second mixture; and thereafter (iic) mixing the first and second mixtures together.

15. An article comprising the polyolefin fiber according to claim 1.

16. The article according to claim 15, wherein the article is a fabric.

* * * * *